United States Patent [19]

Grant

[11] Patent Number: 5,029,631

[45] Date of Patent: Jul. 9, 1991

[54] PROCESS FOR BONDING A MIXTURE OF SUBSTANCES TOGETHER

[76] Inventor: David S. Grant, Rte. 3, Box 277, Hot Springs, Ark. 71913

[21] Appl. No.: 366,595

[22] Filed: Jun. 15, 1989

[51] Int. Cl.[5] ..... B22D 27/02

[52] U.S. Cl. ..... 164/495; 164/499; 204/156; 204/164

[58] Field of Search ..... 164/466, 492, 495, 498, 164/499, 502; 204/156, 164

[56] References Cited

U.S. PATENT DOCUMENTS

| | | | |
|---|---|---|---|
| Re. 20,349 | 5/1937 | Hoke | 164/498 |
| 1,978,222 | 10/1934 | Otte | 164/498 |
| 3,213,495 | 10/1965 | Buehl | 164/495 |
| 3,356,601 | 12/1967 | Inoue | 204/156 |
| 3,383,298 | 5/1968 | Wilson | 204/156 |
| 3,597,519 | 8/1971 | Kemeny | 164/495 |
| 4,244,796 | 1/1981 | Rummel et al. | 164/498 |

FOREIGN PATENT DOCUMENTS

| | | | |
|---|---|---|---|
| 118332 | 9/1979 | Japan | 164/495 |
| 1057178 | 11/1983 | U.S.S.R. | 164/498 |
| 163823 | 5/1921 | United Kingdom | 204/156 |
| 301930 | 11/1929 | United Kingdom | 204/156 |

*Primary Examiner*—Richard K. Seidel
*Assistant Examiner*—Edward A. Brown
*Attorney, Agent, or Firm*—Walker & McKenzie

[57] ABSTRACT

A process for bonding a mixture of substances together. The process includes the steps of forming a mixture of substances; heating the mixture of substances until the mixture is molten; pouring the molten mixture of substances into a mold; and forming a magnetic field around the mold.

8 Claims, 1 Drawing Sheet

PROCESS FOR BONDING A MIXTURE OF SUBSTANCES TOGETHER

BACKGROUND OF THE INVENTION

1. Field of the Invention

The present invention relates, in general, to a process for bonding a mixture of substances such as cadium and monel together.

2. Information Disclosure Statement

Various metal alloys are typically produced by merely melting a mixture of substances in an open-hearth furnace, a Bessemer converter, etc. While many alloys can be easily produced by such a process, other mixtures of substances having greatly differing densities (e.g., lead and aluminum) have required processing in a zero gravity environment. Other mixtures have not produced useful alloys because the various substances thereof settle out upon cooling.

SUMMARY OF THE INVENTION

The present invention is directed toward providing a process for bonding a mixture of substances together. The process of the present invention includes, in general, the stejps of forming a mixture of substances; heating the mixture of substances until the mixture is molten; pouring the molten mixture of substances into a mold; and forming a magnetic field around the mold.

DESCRIPTION OF THE PREFERRED EMBODIMENT

Figure 1:
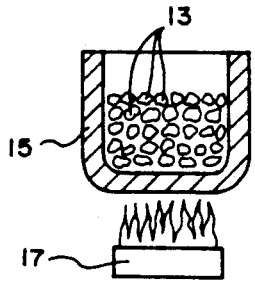
FIG. 1 is a diagrammatic view of a step of the process of the present invention.
Figure 2:
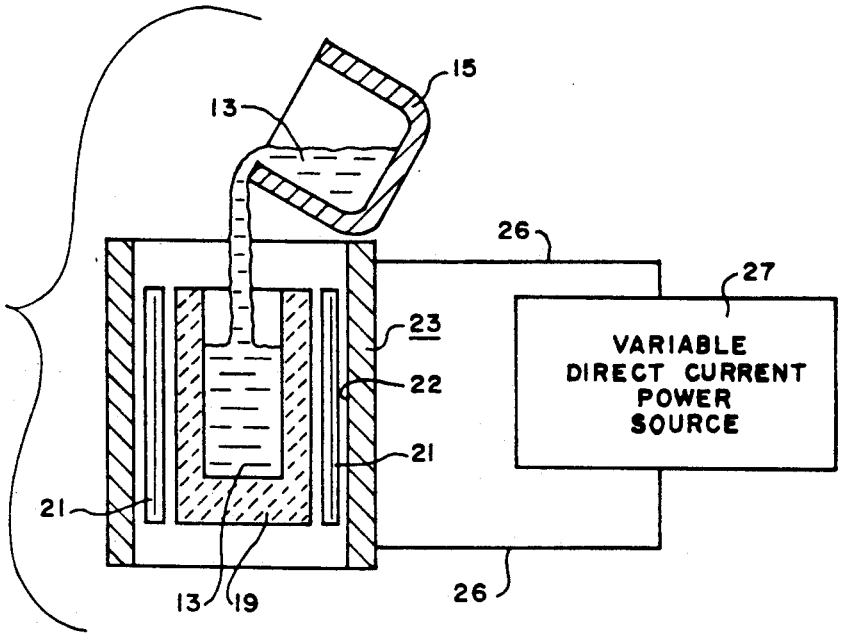
FIG. 2 is a diagrammatic view of another step of the process of the present invention.

The preferred embodiment of the process of the present invention consists of molecular bonding substances to change the properties of the substances, i.e., to harden or soften, to increase or decrease conductivity, etc.

The perferred embodiment of the process of the present invention includes the step of forming a mixture 13 of substances. Such substances could include elements, compounds, alloys, ceramics, metallic elements, non-metallic elements, etc. The mixture 13 may consist of any mixture of substances provided that one or more of the substances will conduct electricity. In the preferred embodiment, the mixture 13 forms cadium monel and consists of 14.2% barium, 33.8% cadmium, 16.5% nickel, 7.25% copper, 0.675% aluminum, 0.225% iron, 0.175% manganese, 0.125% silicon, 0.0375% carbon, and 0.00125% sulfur. That is, the mixture 13 preferably consists of 75% cadium (cadium is an alloy consisting of cadmium and barium) and 25% Monel K500 (monel is an alloy consisting mostly of nickel and copper plus trace elements).

The mixture 13 is places in a standard smelting pot 15 or the like and heated using a standard smelting heating means 17 or the like until the mixture 13 of substances is completely molten. The smelting equipment (e.g., the pot 15 and heating means 17) may be of any typical construction and operation now apparent to those skilled in the art.

The molten mixture 13 of substances is then poured into a mold 19. The mold 19 is preferably ceramic and may be in various desired shapes and sizes as will now be apparent to those skilled in the artt. Heating elements 21 may be provided at or adjacent to the mold 19 to help maintain the mixture 13 of substances molten as the mixture is poured into the mold 19, etc. The heating elements 21 may consist or typical nichrome electrical heating elements or the like well known to those skilled in the art.

Figure 3:
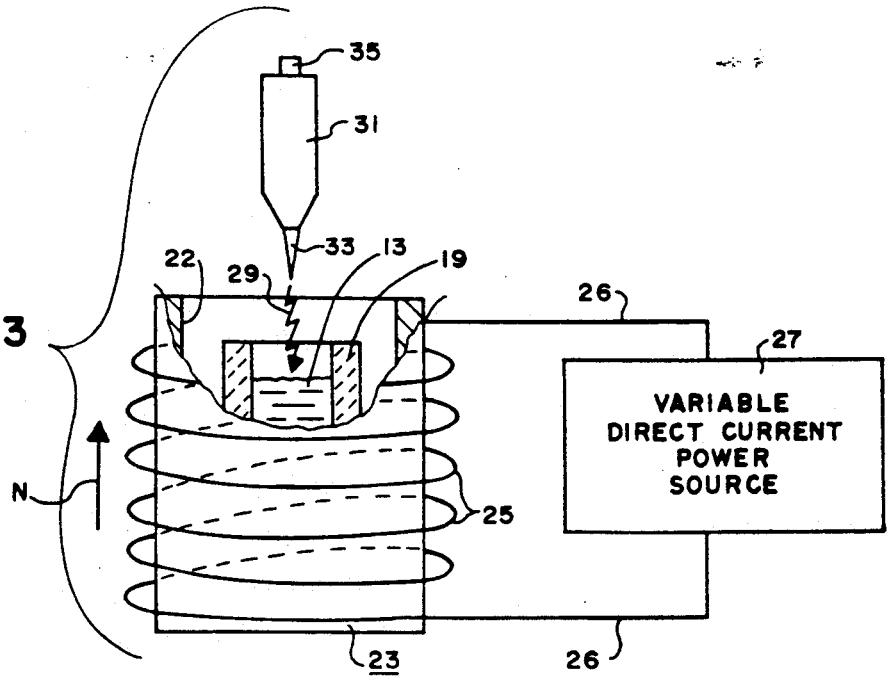
FIG. 3 is a diagrammatic view of another step of the process of the present invention.

A magnetic field is formed around the mold 19. The preferred method of forming a magnetic field around the mold 19 includes placing the mold 19 within the interior 22 of an iron pipe 23 or the like, forming an electrically conductive wire coil 25 about the pipe 23 by, e.g., wrapping copper wire or the like about the pipe 23, and coupling electrically conductive wire leads 26 from the wire coil 25 to a source 27 of direct current electrical power to thereby form an induction coil or the like as will now be apparent to those skilled in the art (the pipe 23 is not necessarily metal—it just supports the coi 25). The source 27 of direct current electrical power preferably consists of a standard variable direct current power source well known to those skilled in the art and capable of producing at least 30 volts of electrical current whereby the power of the magnetic field about the mold 19 can be varied as will now be apparent to those skilled in the art. The wire coil 25 is preferably wrapped in a direction and coupled to the source 27 of direct current electrical power in a manner so that the magnetic north of the magnetic field formed about the mold 19 is in the direction of the arrow N shown in FIG. 3 (i.e., toward the open end of the mold 19). While the mold 19 and magnetic coil 25 can be various sizes shapes, it is important to insure that the mold 19 remains completely inside the magnetic coil 25.

A high frequency electrical current is then preferably introduced to the mixture 13 in its molten state. That is, an electric spark 29 is preferably directed into the molten mixture 13 of substances within the mold 19 while the magnetic field exists aroung the mold 19. The electric spark 29 is preferably a high frequency electric spark such as formed by a typical Telsa coil 31 or the like well known to those skilled in the art having a range of approximately 2 to 8 megahertz. Such a Telsa coil 31 has a negative electrode 33 from which the spark is emitted, and a frequency control dial 35 for allowing the frequency of the spark 29 to be varied as will now be apparent to those skilled in the art.

To more fully explain the preferred embodiment of the process of the present invention, the preferred procedure is as follows:

1. Take the coil 25 and hook it up to the source 27 of direct current electrical power so that the north magnetic pole of the magnet points upward. Make sure that the negative eletrode 33 of the Telsa coil 31 points down into the mold 19.
2. Prepare the mixture 13 by heating the mixture 13 until fluid. More specifically, for cadium monel, melt the cadium, melt the Monel K500, and pour the molten cadium mixture and the molten Monel K500 mixture together. Keep the mixture 13 hot enough to remain fluid.
3. Turn on the variable source 27 of direct current power to about ¾ maximum power to create a magnetic field about the coil 25. Then place the mold 19 down into the coil 25 where the molten mixture 13 can easily be poured into the mold 19 without spilling. Pour the molten mixture 13 into the mold 19.

4. Quickly turn on the Telsa coil 31 and hit the molten mixture 13 with a spark 29. Adjust the frequency control dial 35 until the molten mixture visibly becomes uniform.
5. Turn variable source 27 of direct current power to maximum and turn off the Tesla coil 31.
6. Allow the mixture 13 to cool completely before moving the coil 25 or the mold 19.

The reason for the bond provided by the process of the present invention is not as complex as one might think. The high frequency current causes the atoms of the mixture 13 to line up in a pattern when the mixture 13 is in a molten state. The electro-magnetic field holds the atoms in this position or pattern until the mixture (alloy) has completely cooled and the bonds have become permanent.

The cadium monel produced by the present process has proved to be extremely hard. Nothing has been found that will scratch, bend, or stretch it. The only way found to alter its shape is with a high power laser. Such a laser can cut it, sharpen it, and mark it in just about any way but takes a long time. Such cadium monel is a poor conductor of electricity and cools rapidly after being heated. It has not been possible to melt or boil such caduim monel. Such cadium monel is as strong in liquid helium as it is at room temperature or at 10,000 degrees celsius. It is not ductile or malleable. Its calculated density is 6.73 grams/milliliter but is actually much lighter (similar to aluminum). Acids and other chemicals have had no effect on such cadium monel. It can be used for toxic waste containers, aircraft and space programs, constructions (rods and panels), sawblades and drillbits, bulldozer teeth, housing for fusion reactors, armor, etc. Other mixtures (e.g., zinc and chromiun) bonded by the process of the present invention could be used to form high capacity room temperature superconductors. Other mixtures could be used for the construction of solar cells, etc. The process of the present invention has been used to alloy lead and aluminum and eliminates the need for "zero gravity" in making odd alloys like lead-aluminum metals with greatly differing densities. The process of the present invention applies to any mixture of substances containing one or more conductors of electricity. While the process has been described in detail for cadium monel, the metals can be substituted for any other metals or substances containing one or more conductors.

Although the present invention has been described and illustrated with respect to a preferred embodiment and a preferred use therefor, it is not to be so limited since modifications and changes can be made therein which are within the full intended scope of the invention.

I claim:

1. A process for bonding a mixture of substances together, said process comprising the steps of:
(a) forming a mixture of substances;
(b) heating said mixture of substances until said mixture of substances is molten;
(c) pouring said molten mixture of substances into a mold;
(d) forming a magnetic field around said mold; and
(e) directing a high frequency electric spark into said molten mixture of substances within said mold while said magnetic field is formed around said mold.

2. The process of claim 1 in which is included the step of adjusting the frequency of said electric spark to 2 megahertz or higher.

3. The process of claim 1 in which is included the step of adjusting the frequency of said electric spark within the range of 2 to 8 megahertz until said molten mixture visibly becomes uniform.

4. The process of claim 3 in which is included the step of maintaining said magnetic field around said mold until said mixture of substances completely cools.

5. A process for molecular bonding a mixture of substances together, said process comprising the steps of:
(a) forming a mixture of substances;
(b) heating said mixture of substances until said mixture of substances is molten;
(c) pouring said molten mixture of substances into a mold;
(d) forming a magnetic field around said mold while said magnetic field is formed around said mold;
(e) introducing a high frequency electric current to said molten mixture of substances within said mold while said magnetic field is formed around said mold;
(f) adjusting the frequency of said electric current within the range of 2 to 8 megahertz until said molten mixture visibly becomes uniform; and
(g) maintaining said magnetic field around said mold until said mixture of substances completely cools.

6. A process for bonding a mixture of substances together, said process comprising the steps of:
(a) forming a mixture of substances;
(b) heating said mixture of substances until said mixture of substances is molten;
(c) causing the atoms of said mixture of substances to line up in a pattern while said mixture of substances is molten by directing a high frequency electric spark into said molten mixture of substances; and
(d) holding the atoms of said mixture of substances in said pattern until said mixture of substances has completely cooled.

7. The process of claim 6 in which is included the step of adjusting the frequency of said electric spark to 2 megahertz or higher.

8. The process of claim 6 in which is included the step of adjusting the frequency of said electric spark within the range of 2 to 8 megahertz.

* * * * *